US006016944A

United States Patent [19]

Girbert

[11] Patent Number: 6,016,944

[45] Date of Patent: Jan. 25, 2000

[54] WEARABLE TOOL CARRIER

[76] Inventor: Aaron Girbert, P.O. Box 296, Yellow Springs, Ohio 45387

[21] Appl. No.: 08/984,577

[22] Filed: Dec. 3, 1997

Related U.S. Application Data

[63] Continuation-in-part of application No. 08/670,215, Jun. 21, 1996, abandoned.

[51] Int. Cl.[7] ..... A45F 3/04

[52] U.S. Cl. ..... 224/646; 224/627; 224/250; 224/904

[58] Field of Search ..... 224/191, 600, 224/603, 605, 606, 607, 610, 614, 615, 616, 623, 624, 627, 626, 625, 250, 904, 911, 646; 2/94

[56] References Cited

U.S. PATENT DOCUMENTS

| | | | |
|---|---|---|---|
| D. 214,560 | 7/1969 | Kassel . | |
| D. 234,840 | 4/1975 | Adams . | |
| D. 294,198 | 2/1988 | Collins . | |
| 1,383,315 | 7/1921 | Lethern | 224/610 |
| 1,781,162 | 11/1930 | Clark . | |
| 1,884,328 | 10/1932 | Sperling . | |
| 2,037,132 | 4/1936 | Hoyt | 224/623 |
| 2,089,402 | 8/1937 | Murray . | |
| 2,146,570 | 2/1939 | Gordon . | |
| 2,396,118 | 3/1946 | Ohlemeyer . | |
| 2,579,782 | 12/1951 | Booth . | |
| 2,620,479 | 12/1952 | Buck . | |
| 3,074,250 | 1/1963 | Everett . | |
| 3,739,961 | 6/1973 | Soukeras . | |
| 4,262,832 | 4/1981 | Perkins . | |
| 4,346,827 | 8/1982 | Bianchi et al. . | |
| 4,580,707 | 4/1986 | Shoemaker | 224/624 |
| 4,721,238 | 1/1988 | Shoemaker | 224/624 |
| 4,750,652 | 6/1988 | Grant . | |
| 4,785,983 | 11/1988 | DeSantis | 224/623 |
| 4,903,874 | 2/1990 | Shoemaker . | |
| 4,917,281 | 4/1990 | Ostermiller . | |
| 5,246,153 | 9/1993 | Beletsky . | |
| 5,263,618 | 11/1993 | Talavera . | |
| 5,358,159 | 10/1994 | Lundle, Jr. . | |
| 5,361,953 | 11/1994 | Nichols . | |
| 5,775,558 | 7/1998 | Montalbano | 224/605 |

*Primary Examiner*—Gregory M. Vidovich
*Attorney, Agent, or Firm*—B. Craig Killough

[57] ABSTRACT

A wearable tool carrier having two harnesses, with one harnesses worn over each shoulder by inserting the arm of the user through the harness. A tool pouch is provided on one harness for a power tool, and a cargo carrier is provided on the opposite harness. Various articles may be transported by the cargo carrier, including a spare battery for the power tool, a roll of wire, or an accessory carrier. The tool pouch and cargo carrier are positioned underneath the arms of the user, and relatively high up on the torso, where they are out of the way during normal movement of the user.

1 Claim, 5 Drawing Sheets

WEARABLE TOOL CARRIER

This application is a continuation in part of Ser. No. 08/670,215, filed Jun. 21, 1996, now abandoned.

FIELD OF THE INVENTION

This invention relates to devices for transporting tools, and is specifically directed to a multiple purpose tool carrier which may be worn on the upper body of a user.

BACKGROUND OF THE INVENTION

Construction workers and other craftsmen use many tools as they perform their duties. Tools have become increasingly transportable, since battery powered tools are now common use. Battery power allows the portability of power tools without the necessity of extension cords. Accordingly, a worker using a power tool has substantial freedom of movement.

Workers who work at heights, or far from a tool box, need a device for transporting tools, parts and accessories used to perform their duties. It is not convenient or efficient to climb to a work place, and to frequently climb down to retrieve a tool or other equipment.

To facilitate freedom of movement, holsters for power tools have been provided. Holsters allow the worker to store the tool on his or her person, allowing both hands of the worker to be free as necessary. Tool belts are also in use, but these belts position the tools on the wearer such that the belt or the tools snag other objects, presenting a safety hazard to the user, particularly while climbing or working around machinery.

Holsters and tool belts in the prior art have not achieved optimum utility. The placement of a holster on, or around, the waist of a user, such as by a belt, is not satisfactory. The holster is frequently in the way, and may catch or snag during movement, such as climbing. The safety of the user is therefore compromised.

Other tools and parts are also transported by a worker. The convenience of having tools, parts, spare batteries and the like, available to the worker, especially when the worker has climbed or maneuvered to a remote location, is important. However, the carrier for such tools and parts must not compromise the safety of the worker who is climbing or maneuvering in tight quarters. The carrier must be positioned so as to not catch on other articles as the user climbs or maneuvers. The carrier should have versatility to carry various articles.

SUMMARY OF THE PRESENT INVENTION

The present invention provides a tool carrier having two harnesses. One harnesses is worn over each shoulder by inserting the arm of the user through the harness. A pouch is connected to one harness for holding a power tool. A cargo carrier is provided on the opposite harness for accessories, such as a spare battery, tool pouch, or wire.

The pouch is positioned underneath the arm of the user, and relatively high up on the torso, where it is out of the way during normal movement of the user, and will not catch or hang on articles. This position also properly balances the user, while being in an optimum position for storage of the tool and retrieval of the tool for use.

The cargo carrier is positioned on the opposite harness. The cargo carrier is adapted to carry tools, parts, or accessories. The cargo carrier is positioned under the arm, like the pouch, so that it does not catch or snag, for maximum safety.

DESCRIPTION OF THE PREFERRED EMBODIMENT

Figure 1:
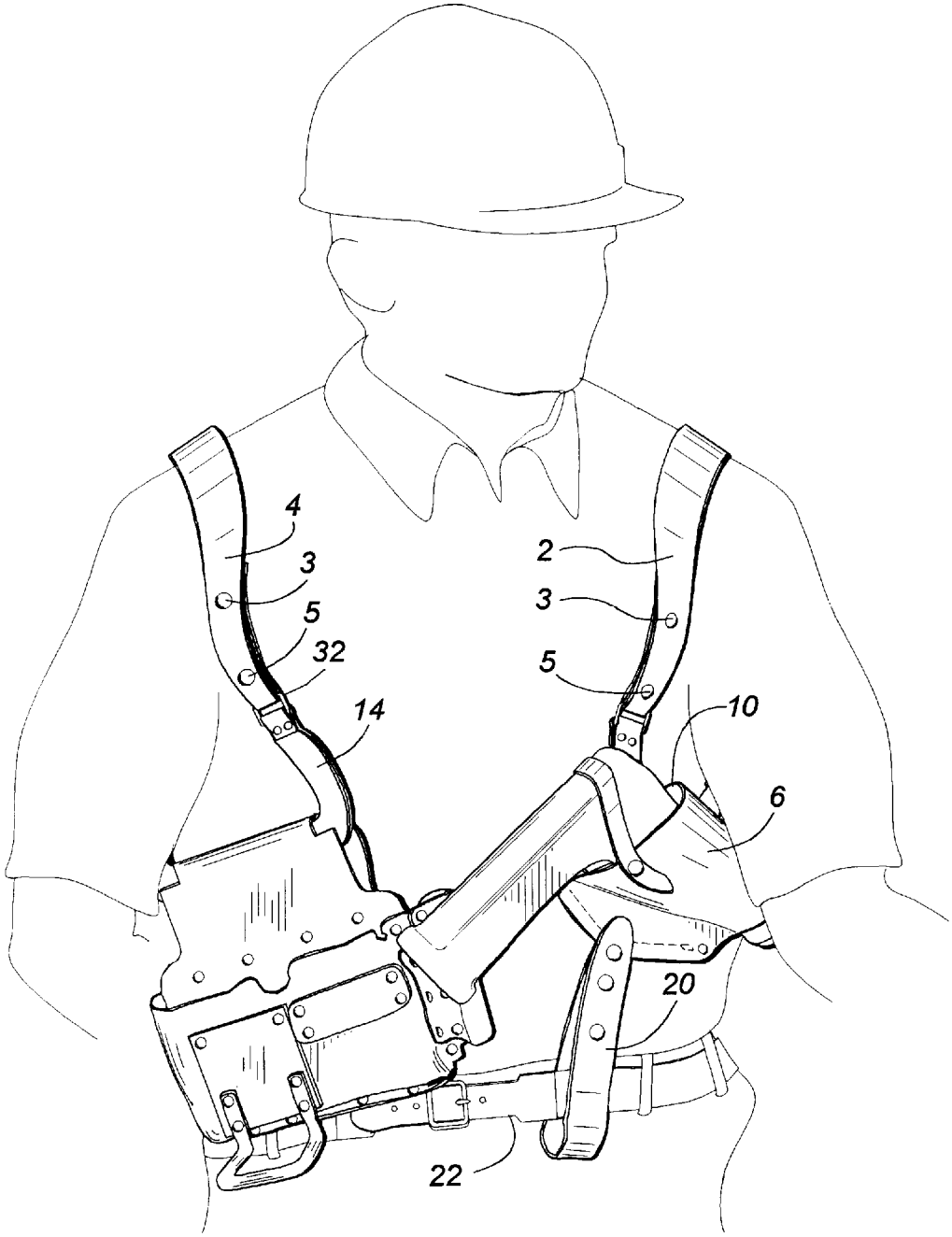
FIG. 1 is a view of the carrier device as worn by a user.
Figure 2:
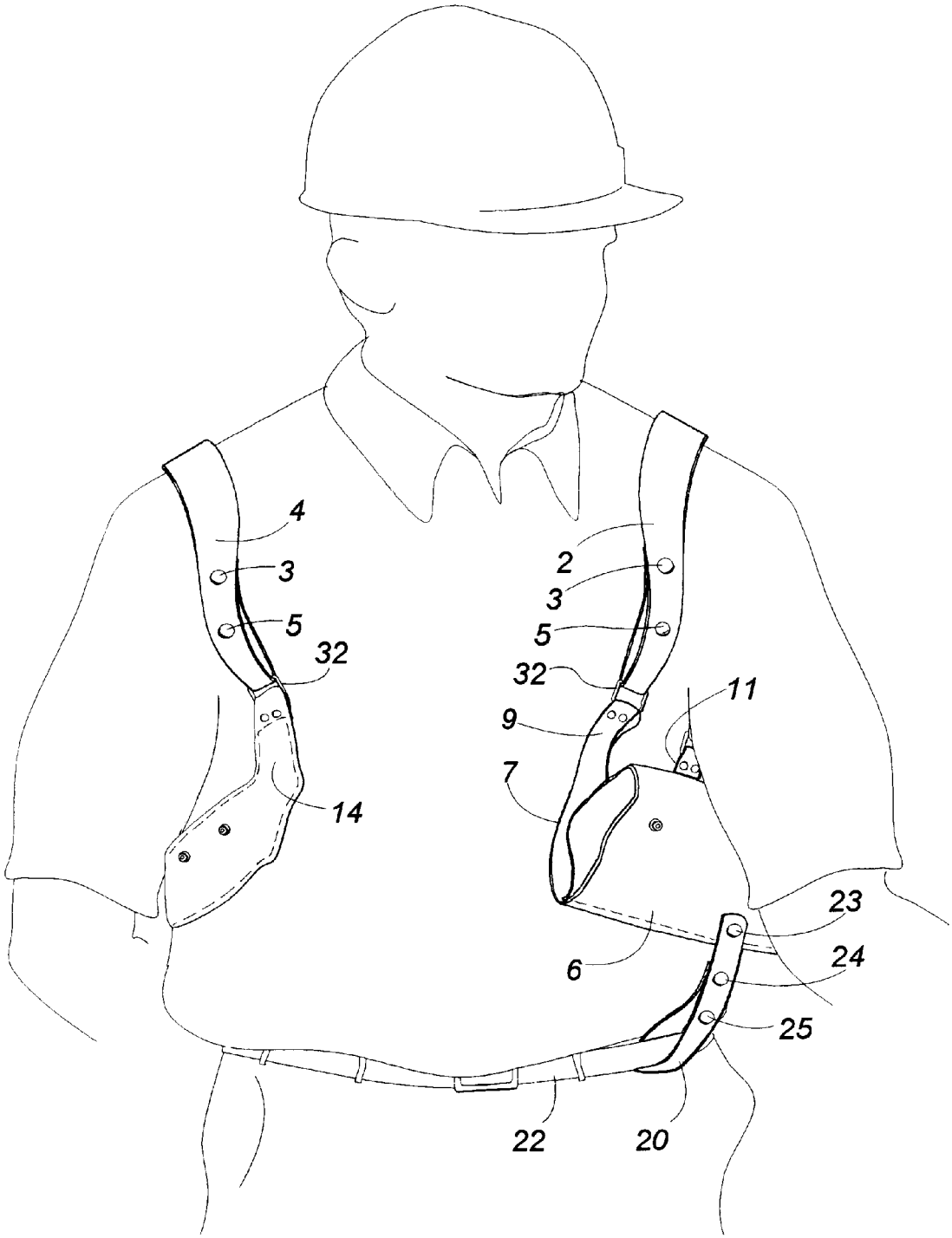
FIG. 2 is a view of the carrier device as worn by a user, shown in another configuration.

Referring now to the drawing figures. FIG. 1 shows a first harness 2 and a second harness 4. The first harness is worn over one shoulder of the user, while the second harness is worn over the opposite shoulder of the user.

A pouch 6 is formed for receiving a power tool 8 and is positioned on the first harness. The pouch has an opening 10 which receives the tool, and as shown in FIG. 1, surrounds the portion of the tool in which the motor of the tool is contained, with the handle of the tool remaining outside of the pouch. The pouch is positioned underneath the arm of the user, and relatively high on the torso, for maximum convenience and weight balance. The opening 10 of the pouch which receives the tool is generally vertical, but is on a slight angle, so that the pouch is oriented to hold the tool within the pouch.

Figure 3:
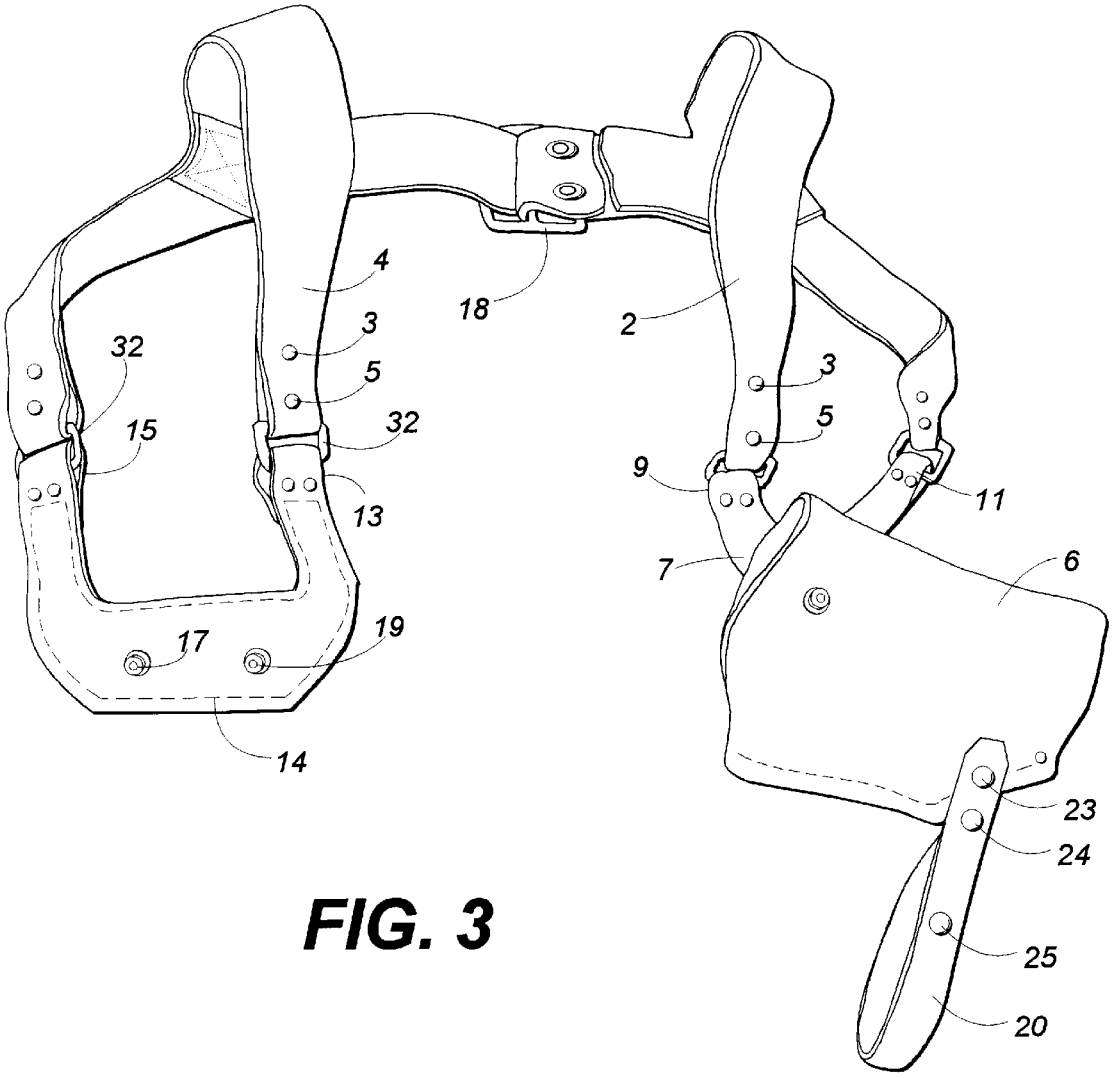
FIG. 3 is a view of the carrier device.
Figure 4:
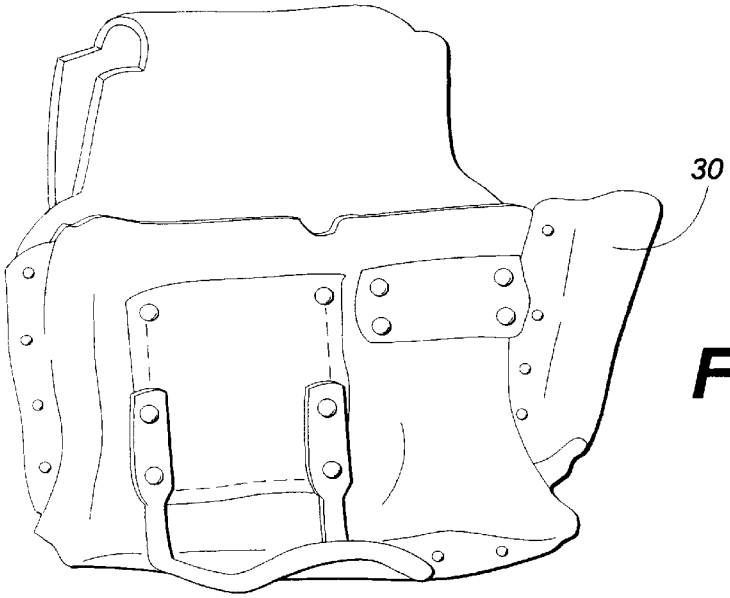
FIG. 4 is a view of the accessory pouch.
Figure 5:
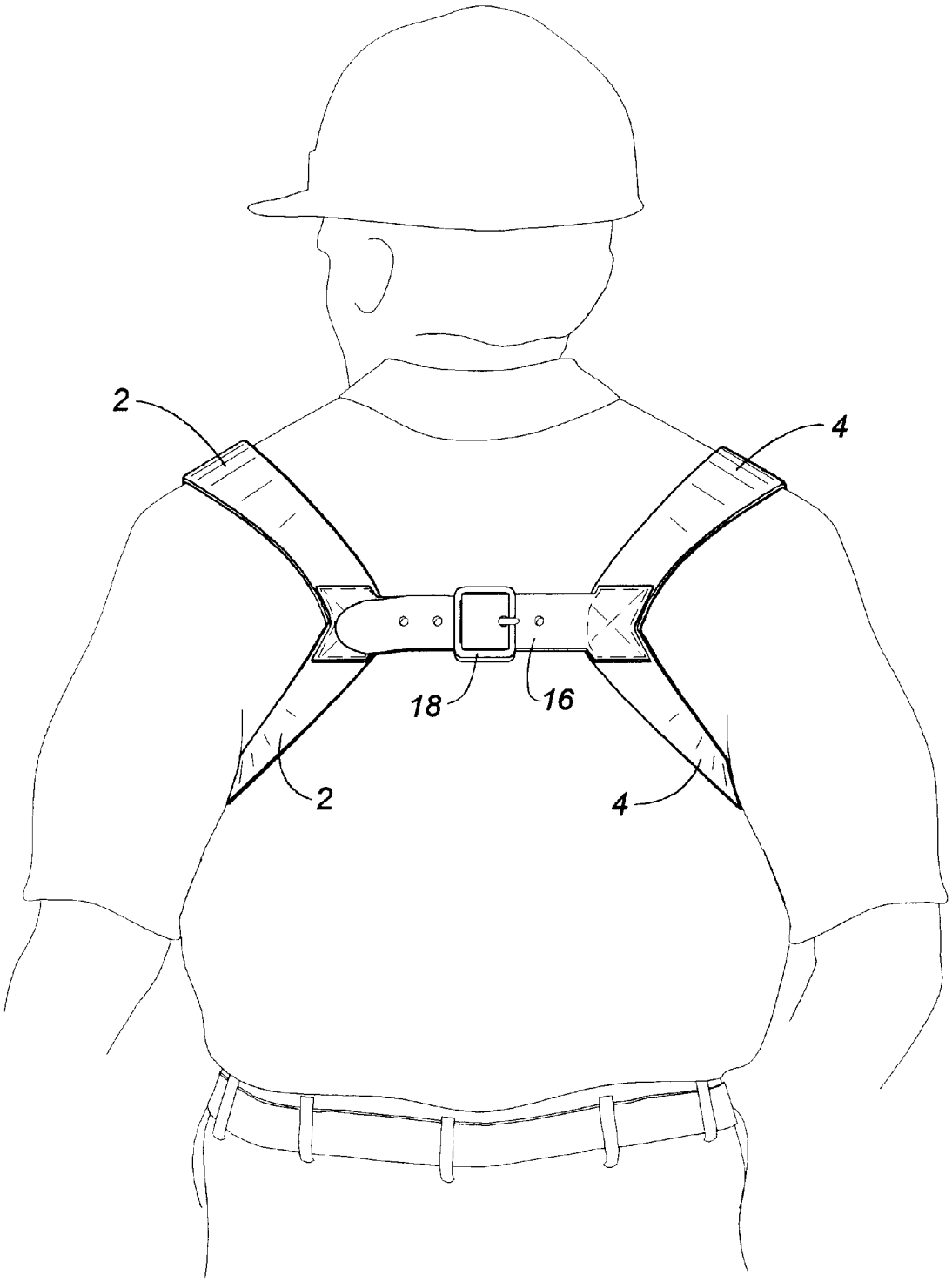
FIG. 5 is a view of the back of the carrier device as worn by a user.
Figure 6:
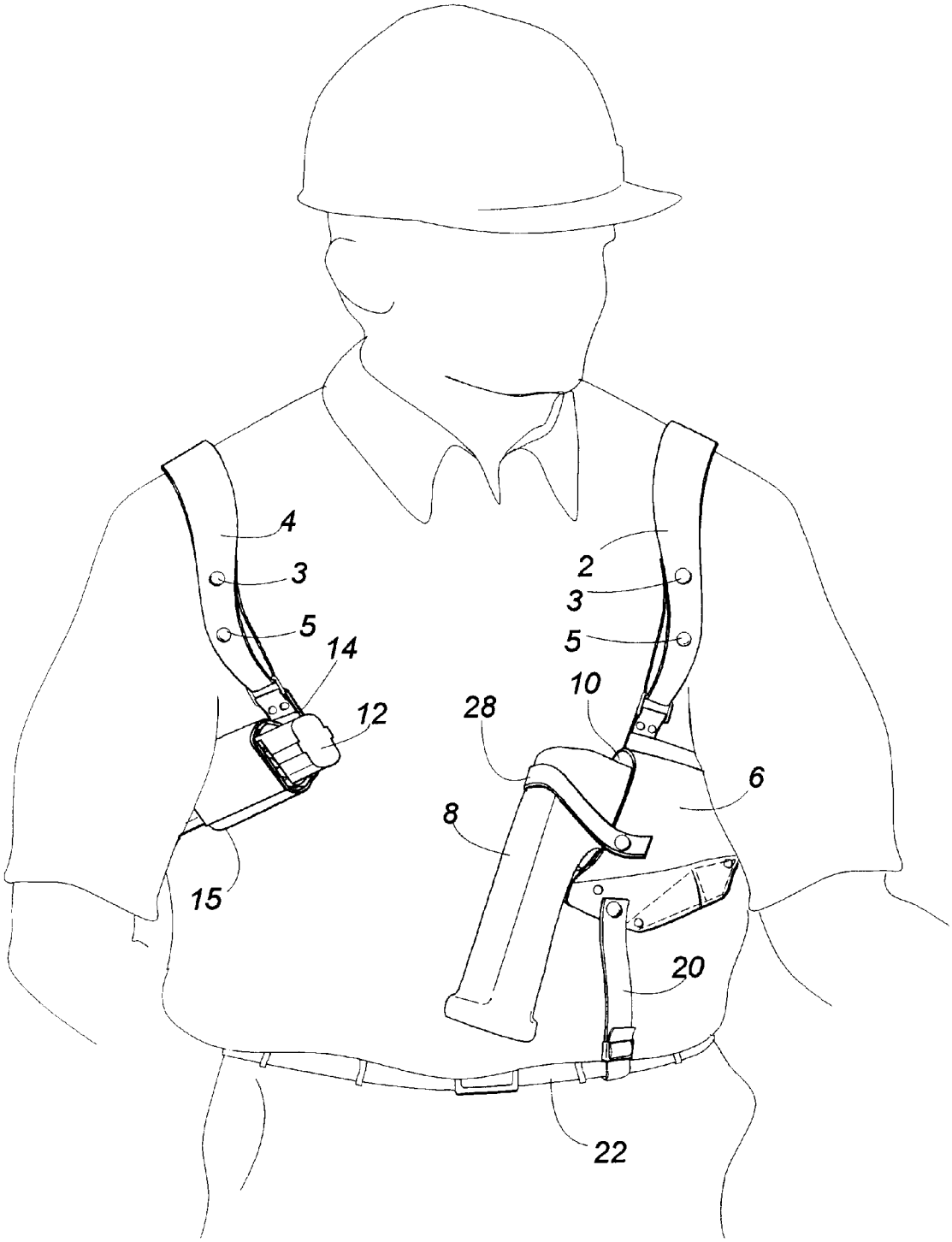
FIG. 6 is a view of the carrier device as worn by a user, shown in another configuration.

A cargo carrier 14 is positioned on the second harness. The cargo carrier has a first end 13 and a second end 15, with each end attached to the second harness 4. The cargo carrier is generally U-shaped, with the generally vertical first end and the generally vertical second end extending from opposite ends of a horizontal member. As shown in FIG. 3. the generally vertical first end, the generally vertical second end, and the horizontal member are unitary and form the 'U' shape of cargo carrier 14. Fasteners, which may be snaps 17,19, are provided on the cargo carrier for attaching a tether or other articles having fasteners which may be connected thereto.

The cargo carrier is removable from the second harness. The cargo carrier is mounted to the second harness by means of screw pins 3,5, which allow the cargo carrier to be removed, or detached at one end for placement of an accessory pouch, a wire tether, or a battery carrier. D-Rings or similar connectors allow the harness to be connected to the cargo carrier and to the tool pouch. The screw pins allow removal and adjustment of the position of the tool pouch and cargo carrier relative to the harnesses. The cargo carrier is positioned generally underneath the arm of the user, and is relatively high on the torso, so that it is positioned out of the way and out of the normal movement of the user.

The lengths of the harnesses are adjustable by means of the screw pins. Multiple eyelets formed in the harnesses allow the screw pins to be positioned to provide various lengths of the harnesses as desired by the user.

The cargo carrier allows various items to be positioned upon it for transporting by the wearer. The cargo carrier is removable from the second harness. The cargo carrier may be inserted through articles, such as spools, as appropriate. Additionally, or alternatively, the accessory carrier 30 may be positioned on the cargo carrier, by sliding the cargo carrier through the accessory carrier.

The tether 20 may be attached by means of snaps to hold articles, such as a roll of wire snapped within the tether, with the tether, in turn, attached to the cargo carrier. A battery pouch 85 may be attached to the cargo carrier, such as by snaps, or by sliding the cargo carrier through a loop on the battery pouch. The battery pouch may transport a spare battery 12. Other devices or accessories may be similarly transported.

A connecting strap 16 connects the first harness with the second harness across the back of the user. Adjustment means 18 may be provided within the connecting strap for adjusting the relative position of the first harness to the second harness and to the user. No other connecting strap, or other straps, are needed, or desired. The use of the single connecting strap adequately achieves the goals of the present invention.

A tether 20 may be provided from the bottom portion of the pouch to the belt 22 of the user. The tether aids in positioning the pouch relative to the user. Multiple fasteners such as snaps 23,24,25 are provided on the tether for securing the tether on the cargo carrier, such as by connecting to snaps 17,19, for securing the tether to the pouch, or for configuring the tether to hold articles such as a spool of wire.

A Y-shaped splitter 7 connects the pouch to the first harness. The Y shaped splitter is connected at each upper point 9,11 of the Y to the first harness by means of ring 32. The Y-shaped splitter is connected to the pouch on the side of the pouch which is next to the body of the user. This provides proper positioning for most wearers of the pouch underneath the arm. The length of the harness may be adjusted by the screw pins and the eyelets.

A safety strap 28 may be provided which aids in retaining the power tool within the pouch.

In use, the wearer inserts one arm through the first harness, and the opposite arm through the second harness. The connecting strap is worn in the back of the device. The adjustment means are adjusted to pull the tool pouch belt relatively high on the torso and in the position underneath the user's arm as shown in FIG. 1, while the adjustment means for the second harness is used to hold the cargo carrier relatively high on the torso and into the position shown in FIG. 1.

The tool pouch provides a means for conveniently carrying the power tool. Other parts and accessories may be carried as needed on the cargo carrier. The position of the power tool and cargo carrier makes the power tool and accessories easily accessible to the user, while also providing the user with good weight balance. The power tool and the cargo are positioned so that they are least likely to be caught or snagged on objects, so as to create a safety hazard.

What is claimed is:

1. A wearable tool carrier, comprising:

a. a first harness having a void therein of sufficient size for insertion of an arm of a user there through, and wherein said first harness is adapted to rest upon a shoulder of said user;

b. a second harness having a void therein of sufficient size for insertion of an arm of a user there through, and wherein said second harness is adapted to rest upon an opposite shoulder of said user, wherein said first harness is connected to said second harness;

c. a pouch which is connected to said first harness;

d. a cargo carrier which is attached to said second harness, wherein said cargo carrier comprises a unitary member which in turn comprises a generally horizontal member, a first generally vertical member extending above and generally upwardly from said generally horizontal member at generally a right angle thereto which is hingably connected to said second harness at an end of said first generally vertical member which is opposite said generally horizontal member, and a second generally vertical member extending above and generally upwardly from said generally horizontal member which is hingably connected to said second harness at an end of said second generally vertical member which is opposite said generally horizontal member; and e. an additional pouch which is positioned over, and rests upon, said generally horizontal member of said cargo carrier, and is retained between said first generally vertical member and said second generally vertical member, the wearable tool carrier further comprising a tether, wherein said tether comprises at least one fastener, wherein said at least one fastener of said tether is selectively connectable to one of a fastener of said pouch and a fastener of said cargo carrier.

* * * * *